US009941647B2

(12) United States Patent
Huang et al.

(10) Patent No.: US 9,941,647 B2
(45) Date of Patent: Apr. 10, 2018

(54) POWER APPARATUS WITH OUTLET IDENTIFICATION CAPABILITY AND OUTLET IDENTIFICATION METHOD OF POWER APPARATUS

(71) Applicant: CYBER POWER SYSTEMS, INC., Taipei (TW)

(72) Inventors: Ling-Ying Huang, Taipei (TW); Hung-Chun Chien, Taipei (TW); Yung-Hao Peng, Taipei (TW)

(73) Assignee: CYBER POWER SYSTEMS, INC., Taipei (TW)

( * ) Notice: Subject to any disclaimer, the term of this patent is extended or adjusted under 35 U.S.C. 154(b) by 139 days.

(21) Appl. No.: 15/003,166

(22) Filed: Jan. 21, 2016

(65) Prior Publication Data

US 2016/0225246 A1 Aug. 4, 2016

(30) Foreign Application Priority Data

Feb. 4, 2015 (TW) ..... 104103690 A

(51) Int. Cl.

| | |
|---|---|
| ***G08B 21/18*** | (2006.01) |
| ***H01R 13/717*** | (2006.01) |
| ***H01R 24/76*** | (2011.01) |
| ***H01R 25/00*** | (2006.01) |

(52) U.S. Cl.

CPC ..... *H01R 25/006* (2013.01); *H01R 13/7175* (2013.01); *H01R 24/76* (2013.01)

(58) Field of Classification Search

None

See application file for complete search history.

(56) References Cited

U.S. PATENT DOCUMENTS 4,195,359 A * 3/1980 Miller ..... G01S 7/527 367/112
5,940,015 A * 8/1999 Thornton ..... H01H 13/702 200/302.2
6,133,724 A * 10/2000 Schweitzer, Jr. .... G01R 31/021 324/133
6,191,348 B1 * 2/2001 Johnson ..... G09B 15/004 84/477 R
7,630,186 B2 * 12/2009 Reynolds ..... G06F 1/266 361/93.1

(Continued)

FOREIGN PATENT DOCUMENTS

JP 2002011154 A * 1/2002

*Primary Examiner* — Quan-Zhen Wang
*Assistant Examiner* — Chico A Foxx
(74) *Attorney, Agent, or Firm* — Bacon & Thomas, PLLC

(57) ABSTRACT

A power apparatus with outlet identification capability and outlet identification method of power apparatus, the outlet identification method uses an identification requirement to enable a power apparatus to identify a plug-in position of at least one powered device, the identification requirement has an internet protocol address and an outlet code of at least one powered device; the power apparatus includes a power distribution equipment, the power distribution equipment has a plurality of outlets, when the power distribution equipment receives an identification requirement, at least one indicator light can be driven to radiate according to the identification requirement, or at least one PDE display can be driven to show an outlet code of the identification requirement.

20 Claims, 21 Drawing Sheets

(56) References Cited

U.S. PATENT DOCUMENTS 8,341,837 B2 * 1/2013 Braunstein ..... H01R 25/006 29/593
8,723,653 B2 5/2014 Jansma
8,868,937 B2 * 10/2014 Liu ..... G06F 1/266 713/300
9,007,186 B1 * 4/2015 Krummey ..... G06F 1/266 340/12.32
9,142,971 B2 * 9/2015 Ewing
9,143,007 B2 * 9/2015 Wu ..... H02J 13/0082
9,292,056 B2 * 3/2016 Watson ..... G06F 1/189
9,331,524 B1 * 5/2016 Yetter ..... H02J 13/0006
9,537,522 B2 * 1/2017 Ewing ..... H04B 1/3827
9,703,342 B2 * 7/2017 Nicholson ..... G06F 1/266
2005/0007221 A1 * 1/2005 Saruwatari ..... H01H 50/08 335/128
2005/0195090 A1 * 9/2005 Finan ..... H02J 9/06 340/656
2005/0246436 A1 * 11/2005 Day ..... H04L 29/06 709/223
2005/0280970 A1 * 12/2005 Reynolds ..... H02H 3/08 361/93.1
2006/0106276 A1 * 5/2006 Shealy ..... A61M 21/00 600/27
2007/0276548 A1 * 11/2007 Uzunovic ..... G06F 1/266 700/297
2008/0104285 A1 * 5/2008 Xiong ..... G06F 11/3041 710/15
2008/0258899 A1 * 10/2008 Stiles ..... B60Q 1/305 340/471
2009/0079416 A1 * 3/2009 Vinden ..... G01R 22/06 324/103 R
2009/0215319 A1 * 8/2009 Gandhi ..... H01R 13/7038 439/654
2009/0234512 A1 * 9/2009 Ewing ..... H04L 12/10 700/295
2009/0236909 A1 * 9/2009 Aldag ..... H01R 25/142 307/39
2010/0005331 A1 * 1/2010 Somasundaram ..... G06F 1/28 713/340
2010/0019575 A1 * 1/2010 Verges ..... H02J 3/14 307/38
2010/0145542 A1 * 6/2010 Chapel ..... G05B 15/02 700/295
2011/0062780 A1 * 3/2011 Verges ..... H02J 13/001 307/38
2011/0072506 A1 * 3/2011 Law ..... H04L 63/1416 726/11
2011/0090042 A1 * 4/2011 Leonard ..... G05B 15/02 340/5.1
2011/0136353 A1 * 6/2011 Spitaels ..... H01R 25/003 439/95
2011/0218689 A1 * 9/2011 Chan ..... G01R 21/00 700/295
2011/0248823 A1 * 10/2011 Silberbauer ..... H05K 7/1498 340/10.1
2011/0256742 A1 * 10/2011 Panella ..... H04L 41/12 439/65
2011/0288938 A1 * 11/2011 Cook ..... G06Q 30/0251 705/14.66
2011/0291813 A1 * 12/2011 Jansma ..... G06F 1/266 340/10.5
2011/0296224 A1 * 12/2011 Ewing ..... G06F 1/26 713/330
2012/0043830 A1 * 2/2012 Wehrle ..... H05K 7/1468 307/139
2012/0075776 A1 * 3/2012 Ewing ..... G06F 1/26 361/622
2012/0265361 A1 * 10/2012 Billingsley ..... H04L 12/12 700/295
2012/0317428 A1 * 12/2012 Liu ..... G06F 1/266 713/310
2013/0183851 A1 * 7/2013 Takakura ..... H01R 13/465 439/490
2013/0212411 A1 * 8/2013 Nicholson ..... H04L 12/10 713/310
2013/0212419 A1 * 8/2013 Hilburn ..... G06F 1/189 713/340
2013/0246816 A1 * 9/2013 Hsieh ..... G06F 1/266 713/310
2013/0332751 A1 * 12/2013 Iwata ..... G06F 1/26 713/300
2014/0092035 A1 * 4/2014 Su ..... G08C 17/02 345/173
2014/0126116 A1 * 5/2014 Irons ..... H05K 7/1492 361/622
2014/0177471 A1 * 6/2014 Kharitonov ..... H04L 45/02 370/254
2014/0278248 A1 * 9/2014 Whittle ..... G05B 23/0283 702/184
2014/0301088 A1 * 10/2014 Lu ..... G09F 9/33 362/382
2014/0365802 A1 * 12/2014 Igarashi ..... G06F 1/266 713/323
2015/0052371 A1 * 2/2015 Pabba ..... G06F 1/266 713/300
2015/0081878 A1 * 3/2015 Pabba ..... H04L 41/0806 709/224
2015/0130276 A1 * 5/2015 McNeill-McCallum . H02J 3/00 307/23
2015/0207320 A1 * 7/2015 Kashiwagi ..... H02J 3/00 700/286
2015/0311649 A1 * 10/2015 Horne ..... H01R 13/641 439/489
2015/0326020 A1 * 11/2015 Lichter ..... H02J 4/00 307/39
2016/0054771 A1 * 2/2016 Fallon ..... G06F 1/26 713/300
2016/0162000 A1 * 6/2016 Fujiwara ..... H02J 13/00 713/340

* cited by examiner

POWER APPARATUS WITH OUTLET IDENTIFICATION CAPABILITY AND OUTLET IDENTIFICATION METHOD OF POWER APPARATUS

BACKGROUND OF THE INVENTION

1. Field of the Invention

The invention relates to a power apparatus with outlet identification capability and a outlet identification method of power apparatus, the apparatus and method use at least one IP (internet protocol) address and at least one outlet code to enable a PDE (power distribution equipment) to proceed the outlet identification, therefore can identify a plug-in position of at least one powered device.

2. Description of Related Art

U.S. Pat. No. 8,723,653 entitled "Asset identification and management method and system" disclosed the system has a PDU (power distribution unit), the PDU includes a reader, an optional antenna switch, a plurality of antennas, a power supply and a plurality of electrical outlets; each asset needs a transponder and RFID tag, so as to proceed the identification. The above prior-art needs higher apparatus costs, in particular, as far as a server room having more devices needs much more transponders and RFID tags. Thus, there is a requirement of improvement for the above prior-art.

Moreover, cable distribution of server room is complicated, and it will be not easy to identify, the server room must continuously supply power to devices (e.g., server), and the server room can not break off the power; the electrical outlets did not provide for an indication function in the above prior-art, a repairman can not easy to find out the corrected position of the electrical outlets if any device needs to make a replacement, a repair or a test; maybe the repairman imprudently break off the power of other devices, and the imprudence could cause a unexpected result.

SUMMARY OF THE INVENTION

It is therefore an object of the invention to provide a power apparatus with outlet identification capability comprising at least one PDE (power distribution equipment), the PDE has a plurality of outlets, when the PDE receives an identification requirement, the PDE can driver at least one indicator light to radiate according to the identification requirement, or driver at least one PDE display to show a outlet code according to the identification requirement.

It is therefore another object of the invention to provide an outlet identification method of power apparatus, the method use an identification requirement to enable a PDE to identify a plug-in position of at least one powered device, the method comprising a step 1, setting a plurality of identification datum, each identification data has an IP (internet protocol) address and a plurality of outlet codes; a step 2, performing an outlet identification function of a manager, the manager has a user interface, a plurality of PDEs and the manager can be connected to become a network; a step 3, the manager transmits a network packet, the network packet has an identification requirement, the identification requirement has at least one IP address and at least one outlet code; a step 4, at least one PDE has an IP address which is conformed to the IP address of identification requirement, and the conformed PDE can perform an indication function according to the outlet code of identification requirement, therefore can identify a plug-in position of a powered device.

First advantages of the invention is, user does not need to inquire about an IP address and an outlet code of each powered device, and user can quickly find out a correct plug-in position of at least one powered device, therefore can make a replacement, a repair or a test for the powered device, and prevent to imprudently break off the power of other devices, in particular, the invention can be suitable for a server room, which particularly is a server room having more powered devices and complicated cable.

Second advantages of the invention is, a user interface of the invention is easy to operate, user can click any executing key of the user interface to transform a data to an identification requirement, and transmit the identification requirement to a plurality of PDEs by a network packet manner. Moreover, user can select a data or a plurality of datum, and after that user can click a confirming key of the user interface to transform the selected data (or datum) to an identification requirement, and transmit the identification requirement to a plurality of PDEs by a network packet manner.

Third advantages of the invention is, the user interface has an indication function adjustment option, such as a color adjustment option, a flash switch adjustment option or a flash frequency adjustment option. Thus, user can quickly adjust a radiation mode of an outlet indicator light or a display mode of a PDE display.

Fourth advantages of the invention is, the user interface has a device matrix, each device of the device matrix has at least one corresponding description area to point out a plug-in position of each device, when a cursor is moved to a device of the device matrix, the user interface can display a description area. User can click any device of the device matrix, therefore can transmit a network package of identification requirement to a plurality of PDEs. Thus, user can perform an intuitional management and an intuitional operation.

Fifth advantages of the invention is, the PDE of the invention has a plurality of through holes, each outlet indicator light of each outlet is located on an underside of each through hole, an upside of each through hole can dispose a light guiding element to enhance an effect of outlet identification.

The above and other objects, features and advantages of the invention will become apparent from the following detailed description taken with the accompanying drawings.

DETAILED DESCRIPTION OF THE INVENTION

Figure 1:
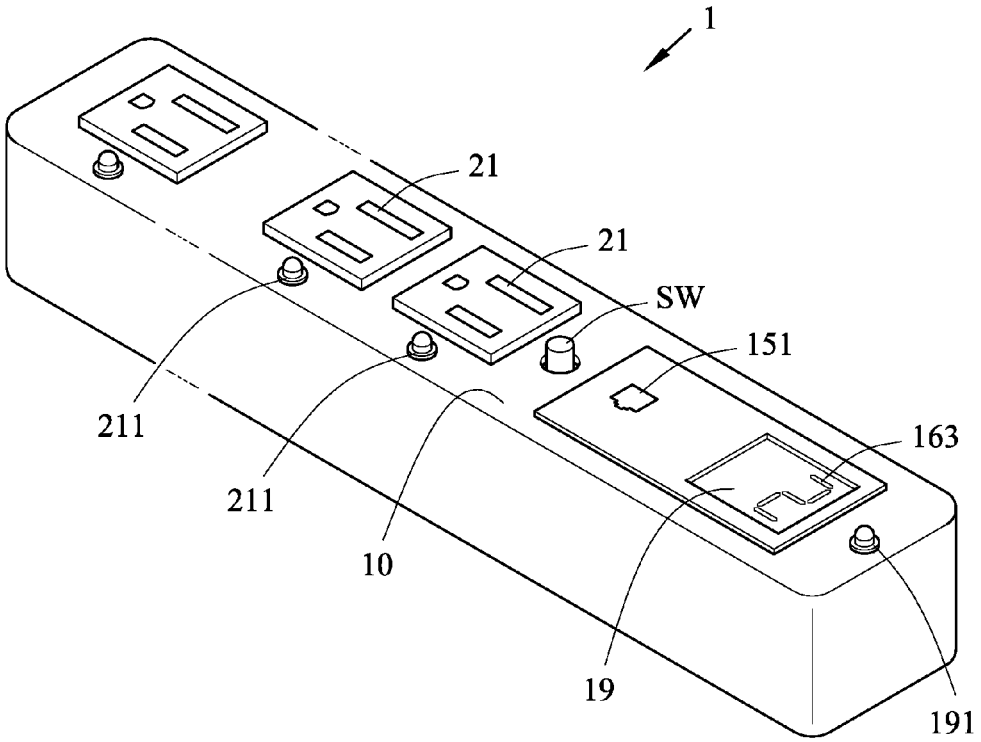
FIG. 1 is a perspective view showing a PDE (power distribution equipment) of a first embodiment of the invention.
Figure 1A:
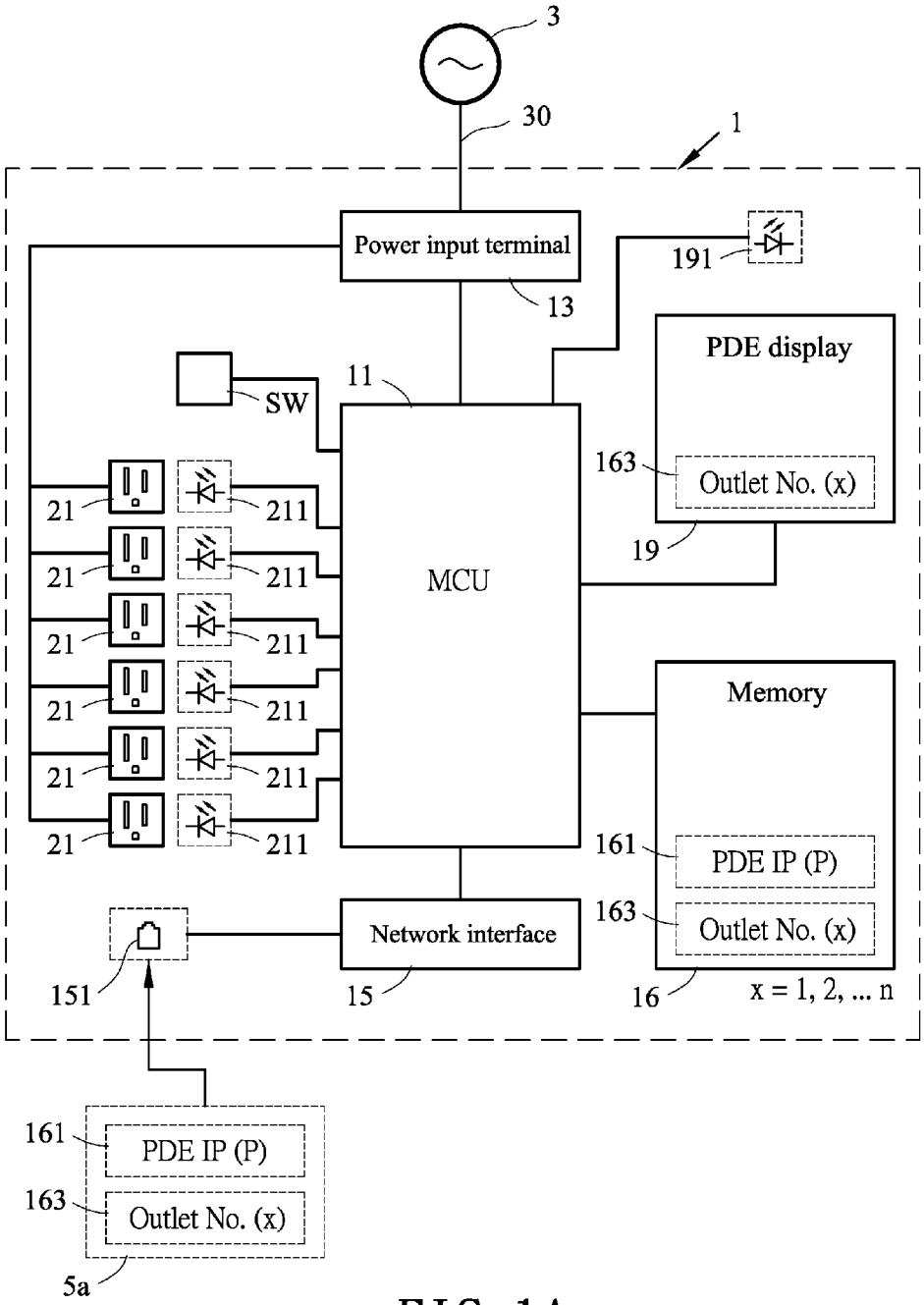
FIG. 1A is a functional block diagram illustrating the PDE of the first embodiment of the invention.
Figure 1B:
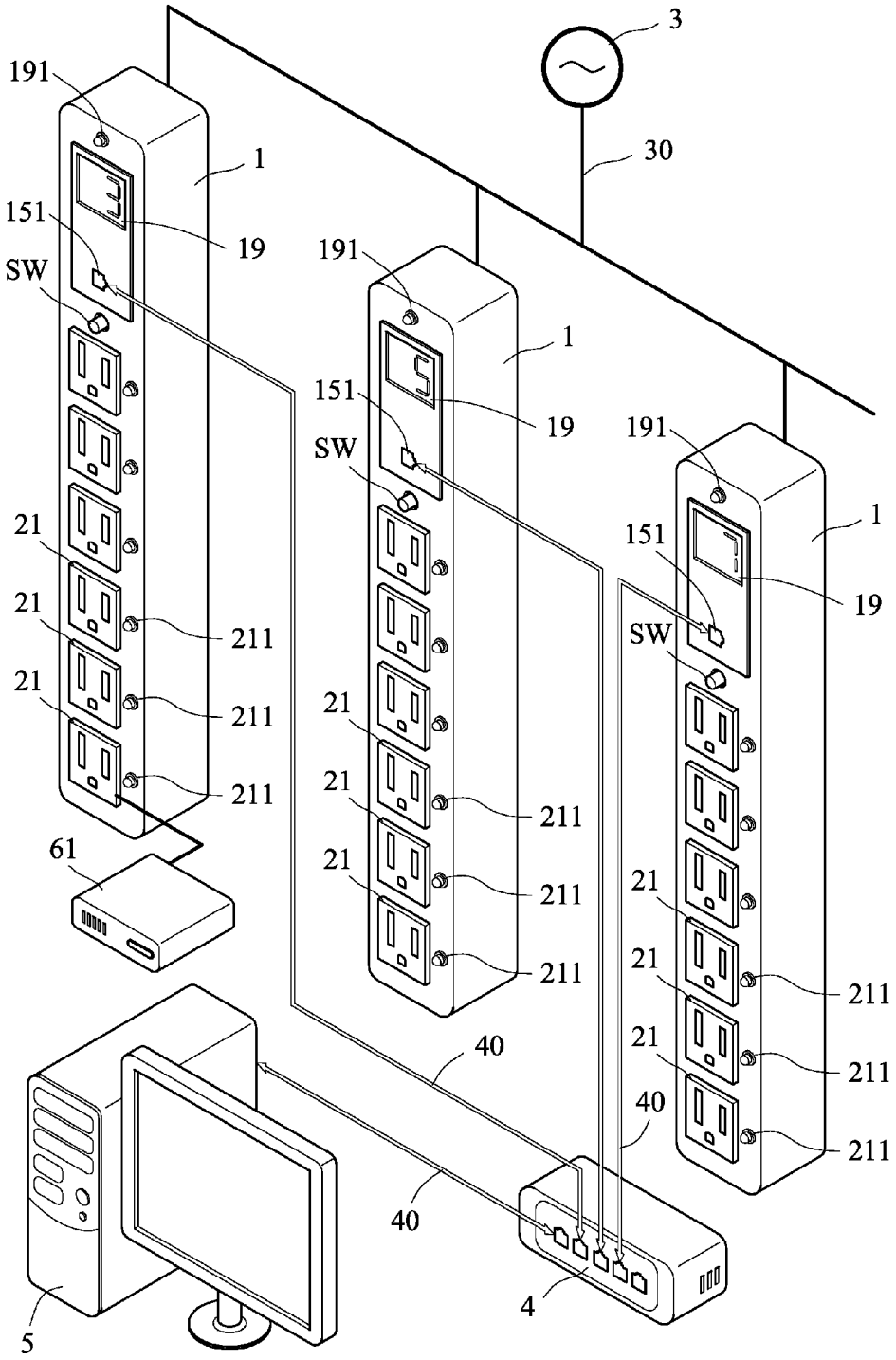
FIG. 1B is a perspective view showing power apparatus of the first embodiment of the invention.
Figure 1C:
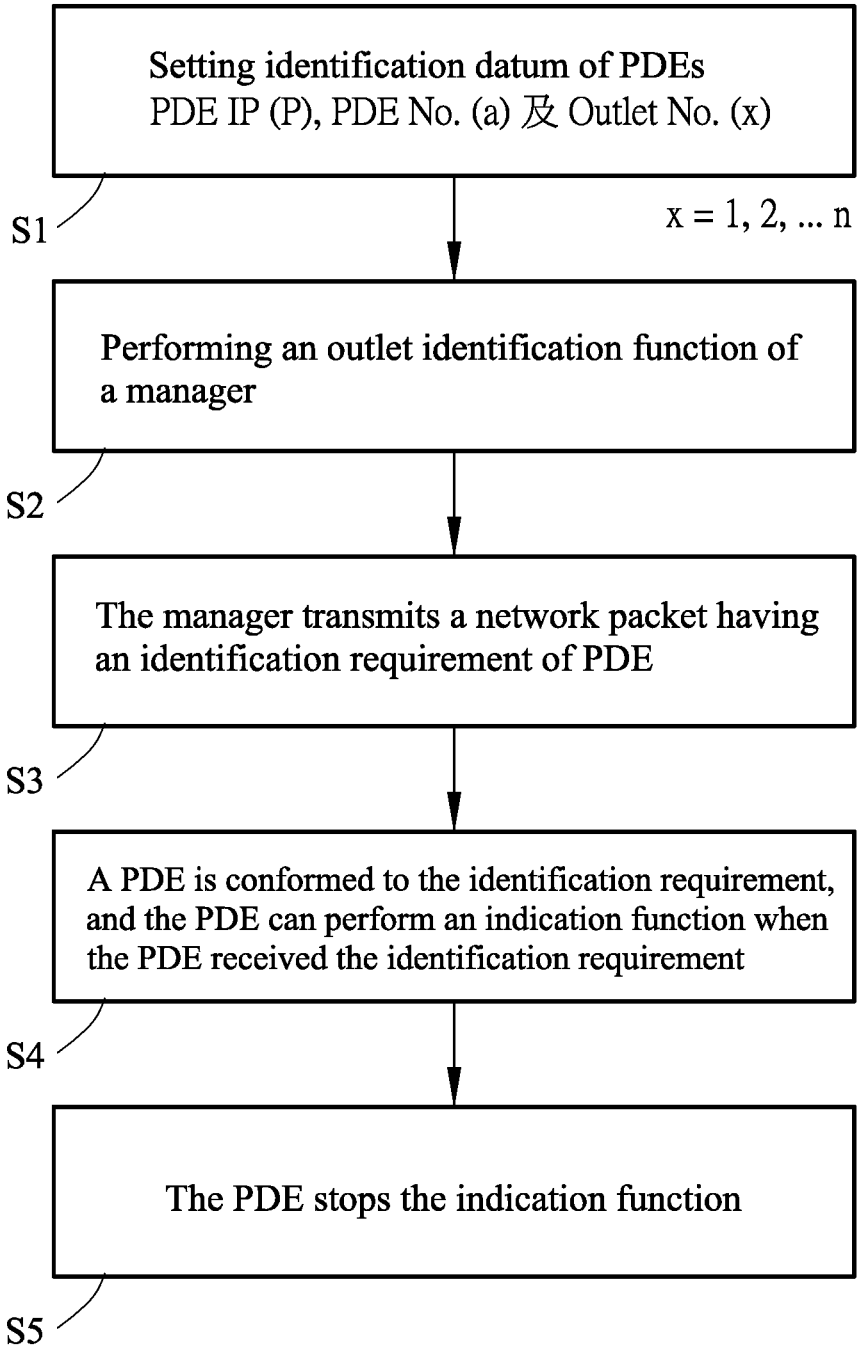
FIG. 1C is a flowchart illustrating an outlet identification method of the first embodiment of the invention.
Figure 1D:
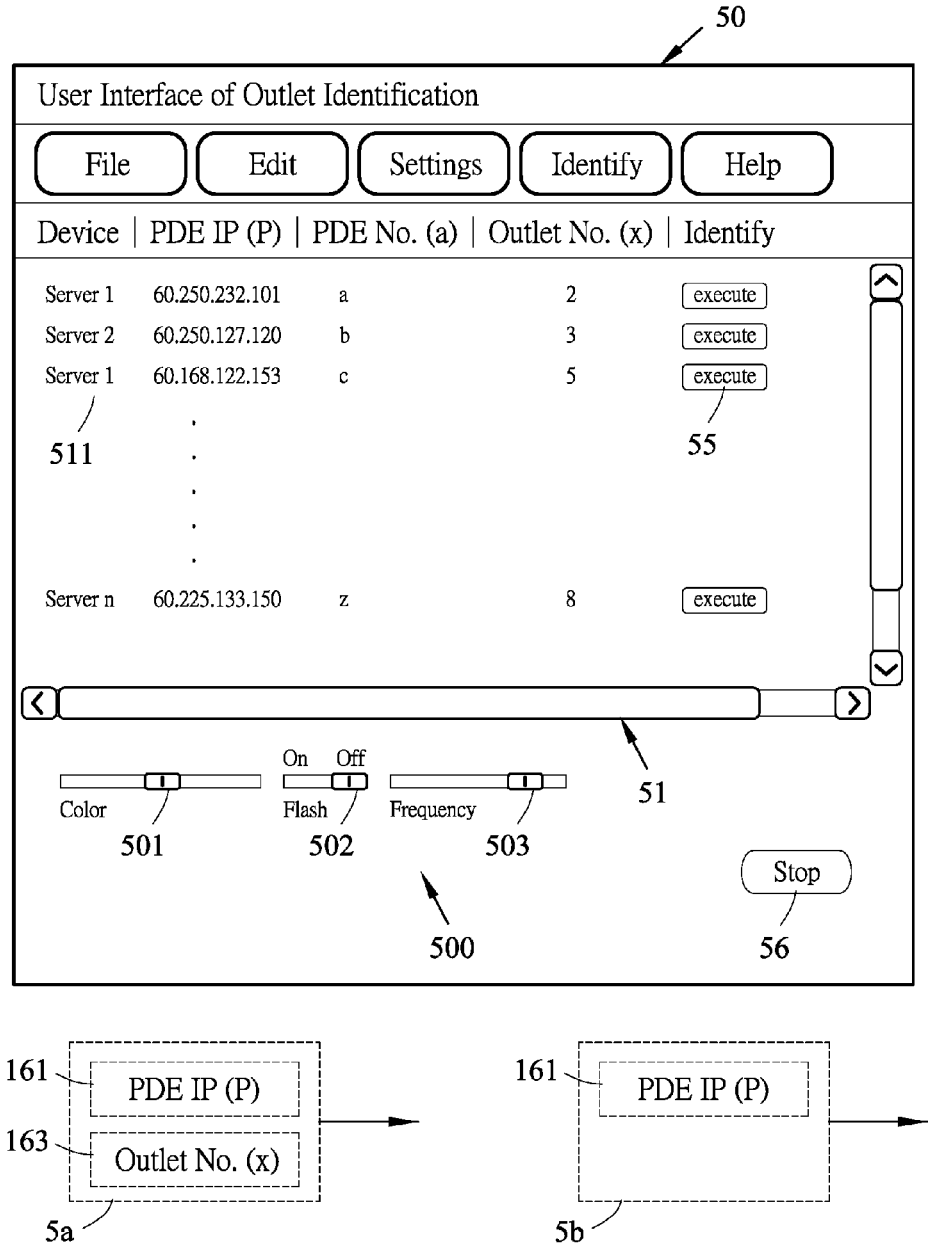
FIG. 1D is a diagram illustrating a user interface of the first embodiment of the invention.

Referring to FIGS. 1 to 1B, power apparatus in accordance with a first embodiment of the invention has a PDE (power distribution equipment) 1, the PDE comprises a processor unit 11, a power input terminal 13, a memory 16 and a plurality of outlets 21; the power input terminal 13 can be connected to a power source 3 by a power line 30, the outlets 21 can distribute input power of the power source 3, the outlets 21 is connected to the power input terminal 13, the processor unit 11 can process an identification requirement 5*a*, the processor unit 11 connected with a network interface unit 15, the processor unit 11 can receive the identification requirement 5*a* via the network interface unit 15, the memory 16 can save an identification data, the memory 16 is connected to the processor unit 11; wherein the identification data has at least one IP (internet protocol) address 161 and outlet codes 163 of the outlets 21, the identification requirement 5*a* has the IP address 161 and at least one outlet code 163, the processor unit 11 can driver at least one outlet indicator light 211 to radiate according to the identification requirement 5*a*, or driver at least one PDE display 19 to show the outlet code 163 according to the identification requirement 5*a*. Thus, user does not need to memorize IP address 161 and outlet code 163 of powered device 61, and user can quickly find out a correct plug-in position of powered device 61, therefore can make a replacement, a repair or a test for powered device 61.

Examples of the executing manner of the outlet indicator light 211, each outlet indicator light 211 has a corresponding outlet code 163 of at least one outlet indicator light 211; wherein each outlet indicator light 211 is located on a top surface 10 of the PDE 1, each outlet indicator light 211 can be selected from LED (light emitting diode) lamp or a small lamp, each outlet code 163 can be selected from a character code, a numeral code, a mixing code of numeral and character, an array number, such as Outlet No. (x), the value x is in a range from 1 to N.

Examples of the executing manner of the network interface unit 15, the network interface unit 15 can be selected from an Ethernet network interface or an optical fiber network interface; wherein the network interface unit 15 has at least one network port 151; wherein the network port 151 can be selected from a RJ45 network socket or an optical fiber network socket; when the power apparatus of the invention has a plurality of PDE 1, the power apparatus can use a network Hub 4 and a plurality of network cable 40 to connect the network interface units 15 of the PDEs 1 and a manager 5, the manager 5 can be selected from a server computer, a personal computer, a notebook computer, a tablet computer or an all-in-one computer.

Examples of an identification manner of the PDEs 1, each top surface 10 of each PDE 1 further a PDE indicator light 191; wherein at least one processor unit 11 of PDE 1 can driver at least one PDE indicator light 191 to radiate according to the IP address 161 of the identification requirement 5*a*, the PDE indicator light 191 can be selected from LED lamp or a small lamp.

Examples of a stopping manner of the PDEs 1 identification, each PDE 1 has at least one switch SW, therefore can stop the radiation of the outlet indicator light 211 and the PDE indicator light 191, the switch SW can be selected from a rocker switch, a push switch, a toggle switch, a DIP switch or a touch switch.

Referring to FIGS. 1A to 1D, an outlet identification method of power apparatus in accordance with the first embodiment of the invention comprises a step S1, setting identification datum of a plurality of PDEs 1, each identification data has an IP address 161 and a plurality of outlet codes 163; a step S2, performing an outlet identification function of a manager 5, the manager 5 has a user interface 50, the PDEs 1 and the manager 5 can be connected to become a network; a step S3, the manager 5 transmits a network packet, the network packet has an identification requirement 5*a*, the identification requirement 5*a* has at least one IP address 161 and at least one outlet code 163; a step S4, at least one IP address 161 of PDE 1 is conformed to the IP address 161 of identification requirement 5*a*, and the conformed PDE 1 can perform an indication function according to the outlet code 163 of identification requirement 5*a*, wherein the indication function is defined as that at least one outlet indicator light 211 can be driven to radiate, or at least one PDE display 19 can be driven to show the outlet code 163 of identification requirement 5*a*; therefore a plug-in position of at least one powered device 61 can be identified by performing the step S2 to the step S4.

Examples of the executing manner of the user interface 50, the user interface 50 has a data form 51, the data form 51 has a device field, an IP address field and an outlet code field; wherein each data 511 has an executing key 55, user can click any executing key 55 to transform the data 511 to an identification requirement 5*a*, and the manager 5 will transmit the identification requirement 5*a* to a plurality of PDEs 1 by a network packet manner.

Examples of a stopping manner of the indication function, the outlet identification method of the invention further comprises a step S5, the manager 5 can perform a function of stopping indication; wherein the user interface 50 has a stop key 56, user can click the stop key 56 to transmit a network packet of stopping requirement 5*b* to the PDEs 1, the stopping requirement 5*b* has at least one IP address 161, at least one IP address 161 of PDE 1 is conformed to the IP address 161 of stopping requirement 5*b*, and the conformed PDE 1 will stop the indication function.

Examples of an adjustment manner of the indication function, the user interface 50 has at least one indication function adjustment option 500; wherein the indication function adjustment option 500 can be selected from a color adjustment option 501, a flash switch adjustment option 502 or a flash frequency adjustment option 503, therefore can quickly adjust a radiation mode of the outlet indicator lights 211 or a display mode of the PDE display 19 by a processor unit 11. Thus, an administrator can assign a replacement task, a repair task or a test task of each powered device 61, a repairman will correctly identify at apparatus site.

Figure 1E:
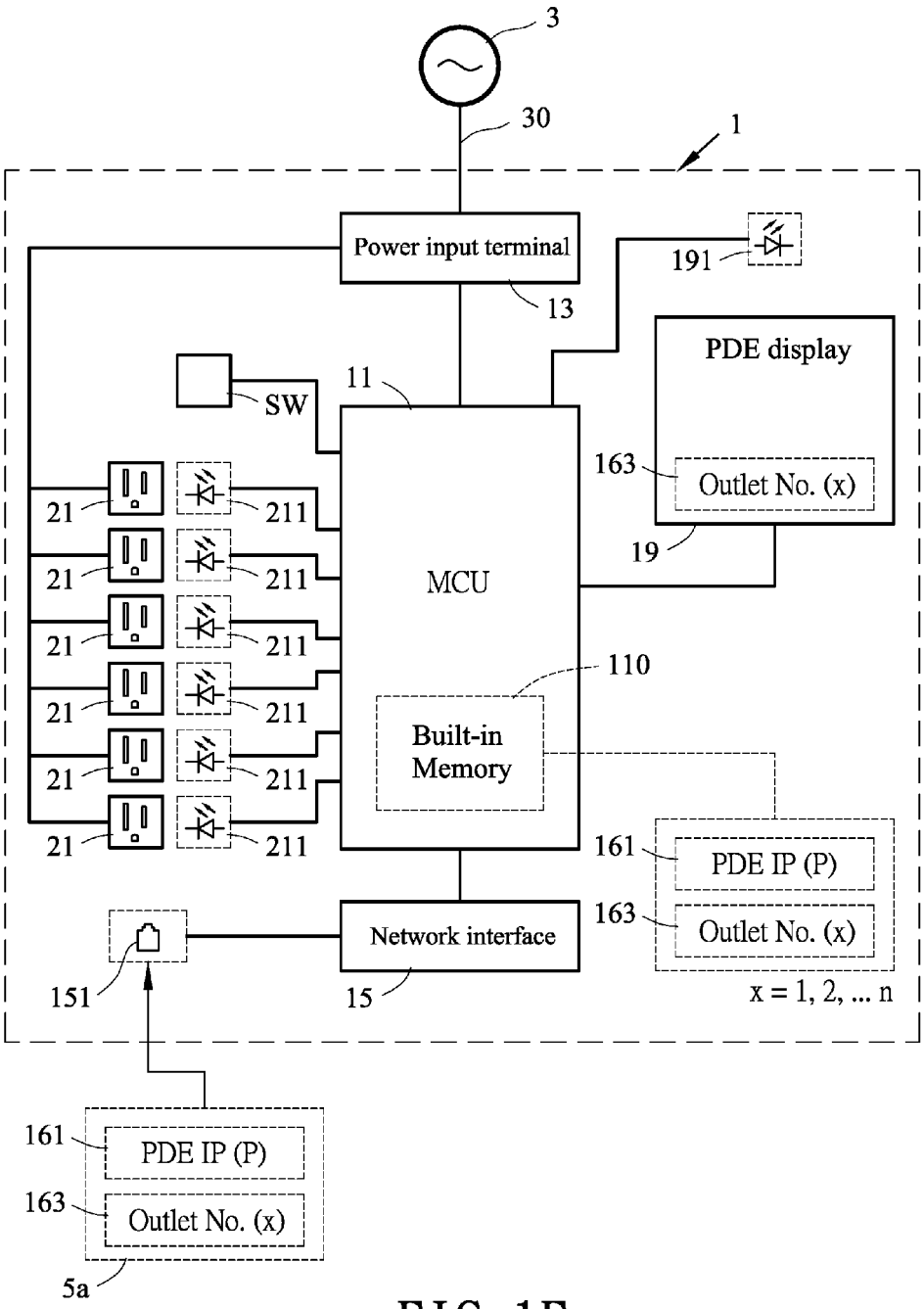
FIG. 1E is another functional block diagram illustrating the PDE of the first embodiment of the invention.

Referring to FIG. 1E, a processor unit 11 in accordance with the first embodiment can be a MCU (microcontroller unit); wherein the processor unit 11 can integrate with a built-in memory 110, therefore can save identification datum, for example, at least one IP address 161 and each outlet code 163 are saved to the built-in memory 110, and thereby simplify constituent of the PDE 1.

Figure 2:
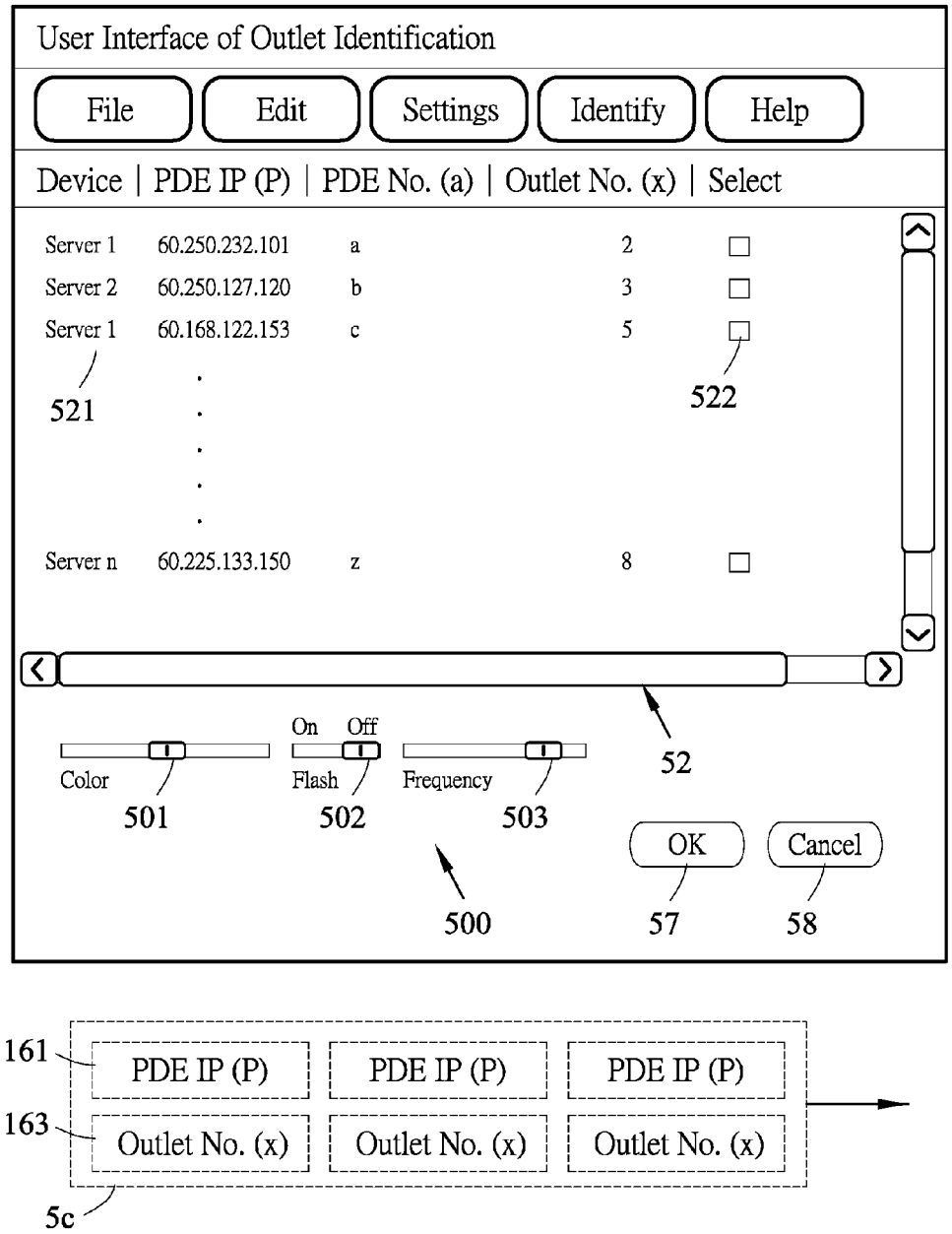
FIG. 2 is a diagram illustrating a user interface of a second embodiment of the invention.

Referring to FIGS. 2 to 1B, a user interface 50 in accordance with a second embodiment has a data form 52, a confirming key 57 (e.g., OK key) and a cancel key 58; wherein the data form 52 has a device field, an IP address field, an outlet code field and a select field. Thus, user can select a plurality of datum 521 by a plurality of select field options 522, user can click the cancel key 58 to cancel any select field option 522, and user can click the confirming key 57 to transform a selected data 521 or a plurality of selected datum 521 to an identification requirement 5*c*, and the manager 5 will transmit the identification requirement 5*c* to a plurality of PDEs 1 by a network packet manner.

Figure 3:
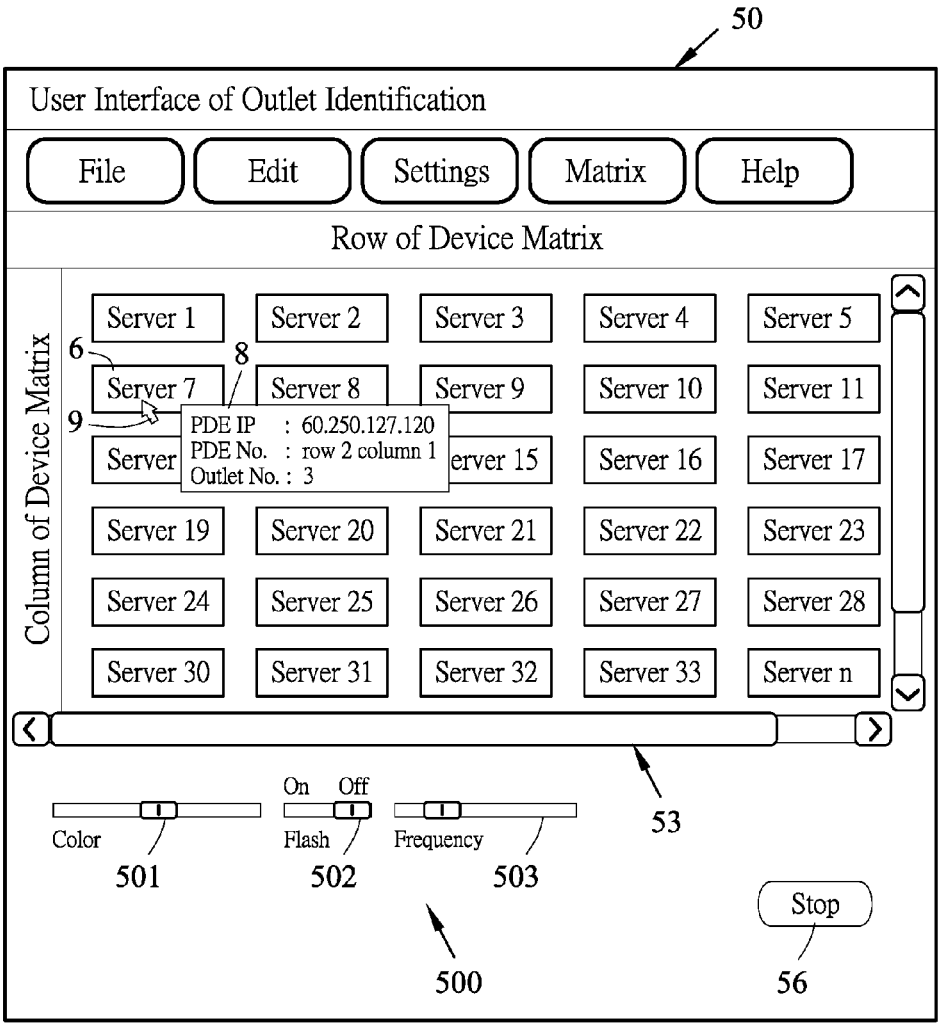
FIG. 3 is a diagram illustrating a user interface of a third embodiment of the invention.
Figure 3:
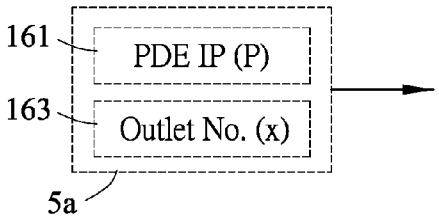

Referring to FIGS. 3 to 1B, a user interface 50 in accordance with a third embodiment has a device matrix 53, which arranged a plurality of devices 6 (e.g., server) by a matrix manner, for example, each device 6 has at least one corresponding description area 8, each description area 8 has at least one IP address and at least one outlet code, therefore can point out a plug-in position of each device 6; when a cursor 9 is moved to a device 6 of the device matrix 53, the user interface 50 can display a description area 8. Moreover, user can click any device 6 of the device matrix 53 to transmit a network package of identification requirement 5*a* to a plurality of PDEs 1. Thus, user can perform an intuitional management and an intuitional operation.

Figure 4:
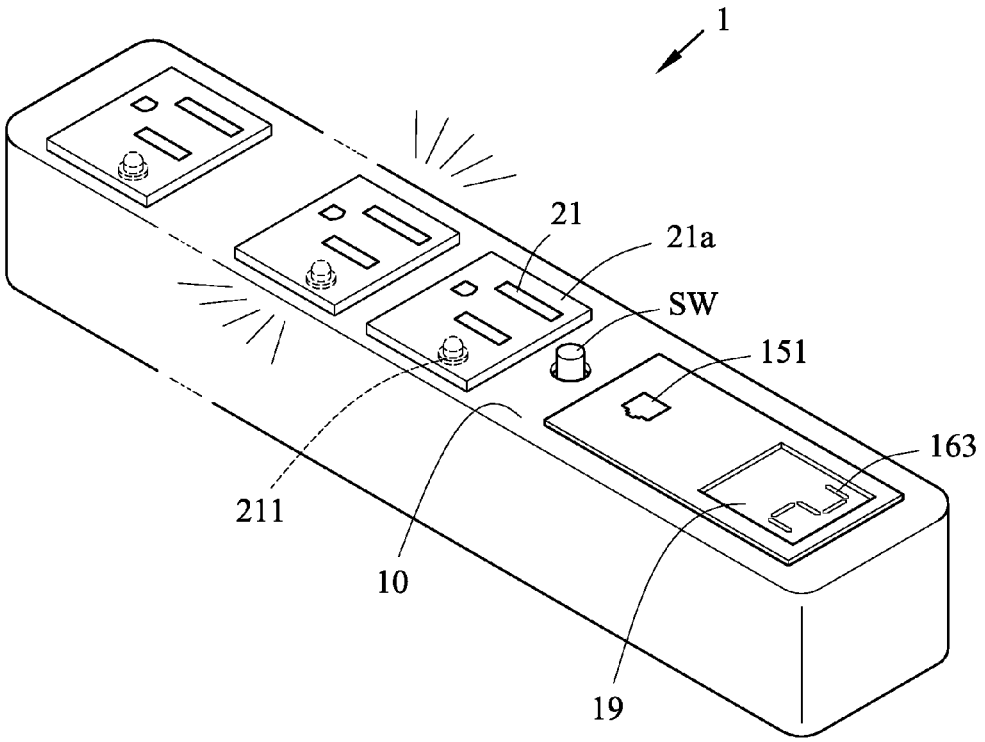
FIG. 4 is a perspective view showing a PDE of a fourth embodiment of the invention.

Referring to FIG. 4, each outlet indicator lights 211 in accordance with a fourth embodiment is located on an underside of each outlet panel 21*a*; wherein the outlet panels 21*a* can be selected from a transparent material, a translucent material or a light guiding material, therefore can protect the outlet indicator lights 211. Thus, a PDE 1 can be provided with an effect of outlet identification by radiation of the outlet panels 21*a*.

Figure 5:
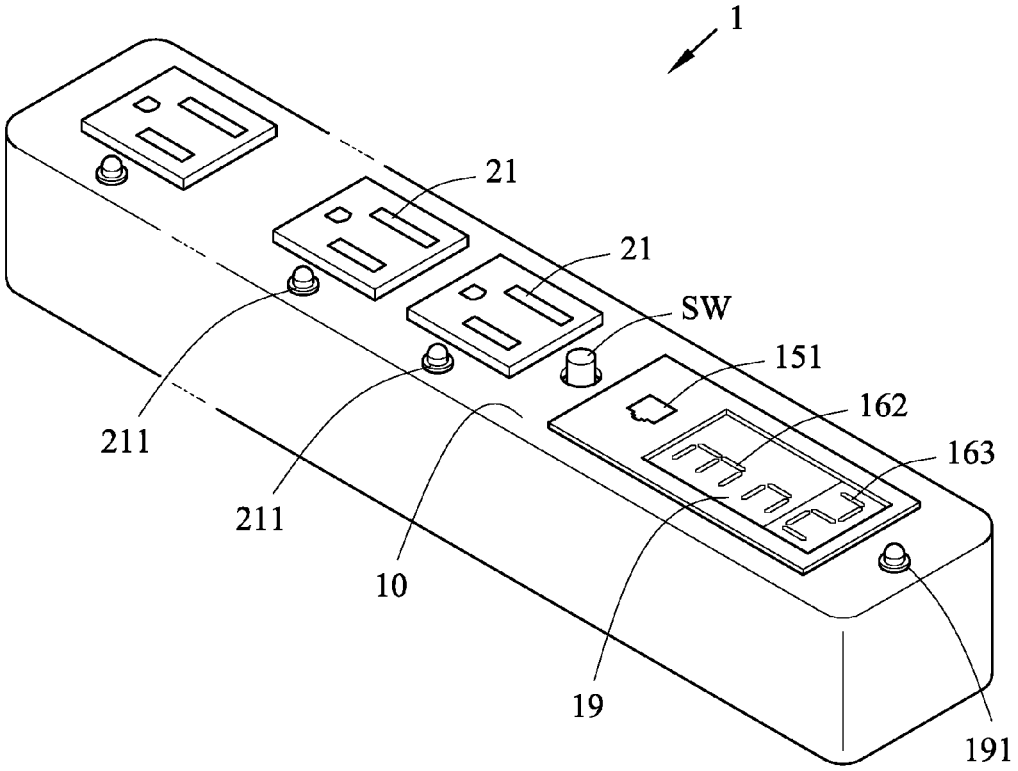
FIG. 5 is a perspective view showing a PDE of a fifth embodiment of the invention.
Figure 5A:
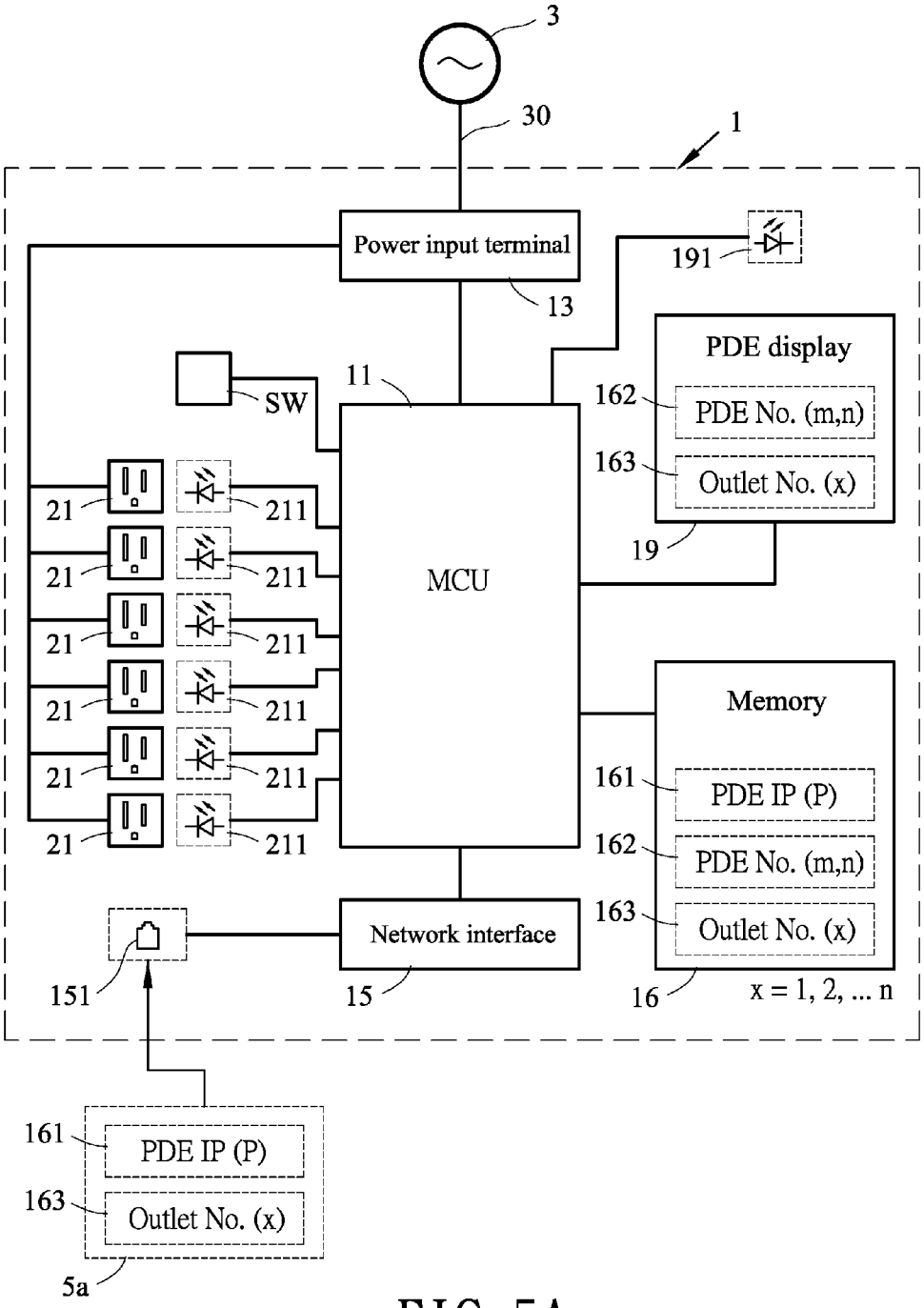
FIG. 5A is a functional block diagram illustrating the PDE of the fifth embodiment of the invention.
Figure 5B:
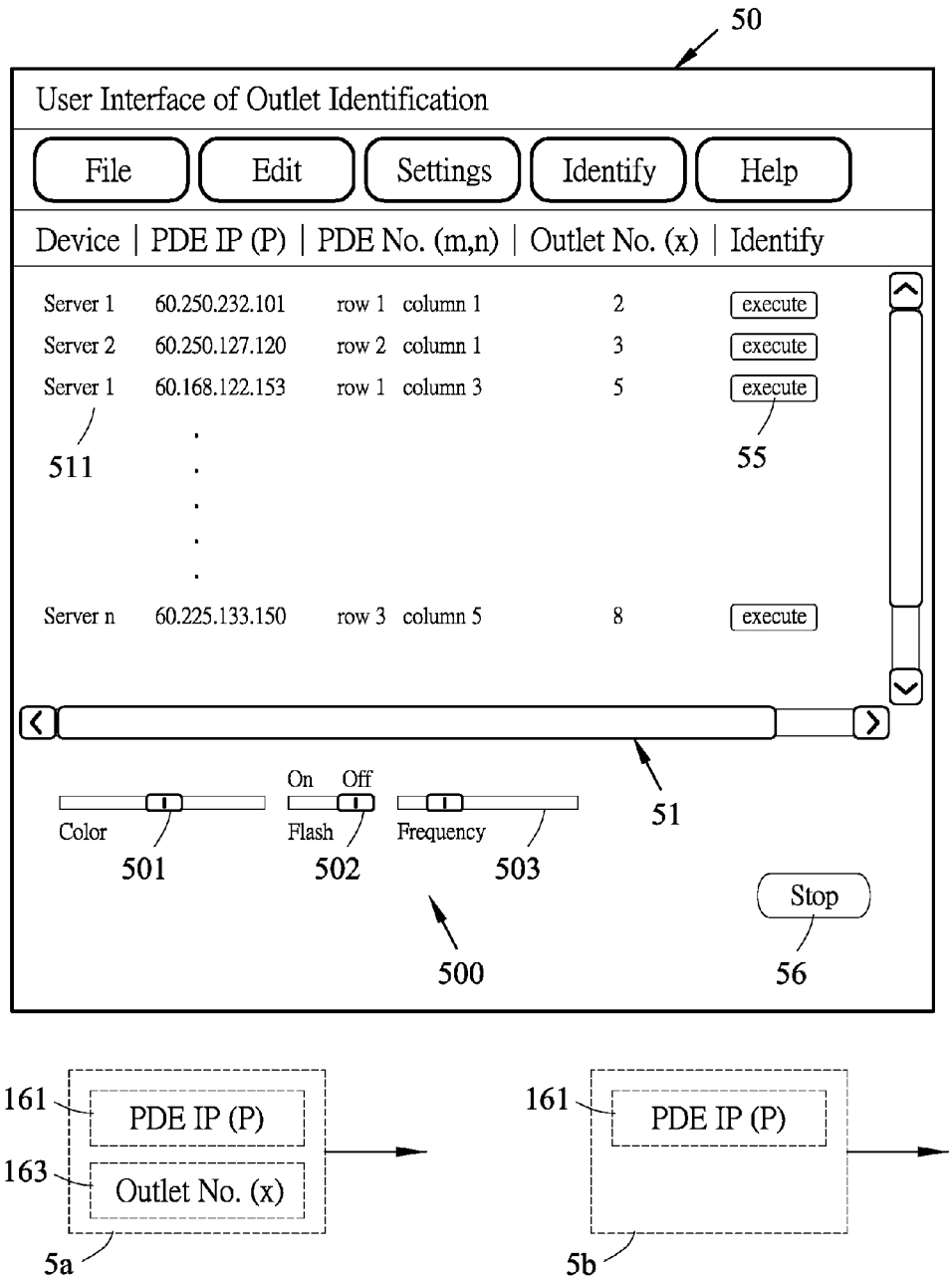
FIG. 5B is a diagram illustrating a user interface of the fifth embodiment of the invention.

Referring to FIGS. 5 to 5B, identification datum of PDE 1 in accordance with a fifth embodiment has at least one IP address 161, a PDE number (PDE code) 162 and each outlet code 163; wherein a PDE 1 is conformed to an identification requirement 5*a*, and the PDE 1 can drive a PDE display 19 to show the PDE number 162 and the outlet code 163 of identification requirement 5*a*; the PDE number 162 can be selected from one-dimensional array value, two-dimensional arrays value or multi-dimensional arrays value, therefore a repairman will know a location of each PDE 1 at apparatus site. Moreover, a data form 51 of user interface 50 further has a PDE number field, therefore an administrator will know a distribution position of each PDE 1.

Figure 5C:
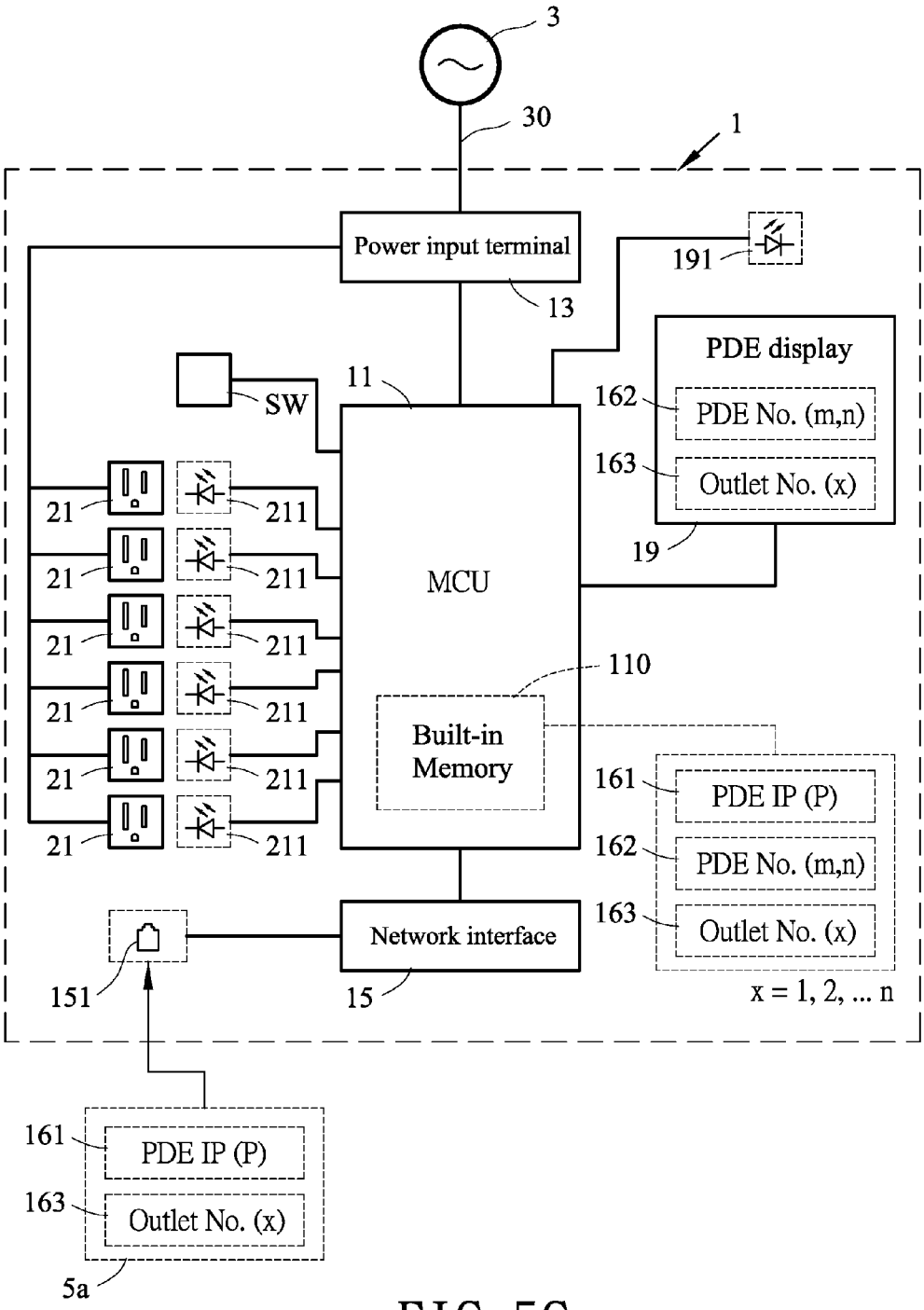
FIG. 5C is another functional block diagram illustrating the PDE of the fifth embodiment of the invention.

Referring to FIG. 5C, a processor unit 11 in accordance with the fifth embodiment can be a MCU (microcontroller unit); wherein the processor unit 11 can integrate with a built-in memory 110, therefore can save identification datum, for example, at least one IP address 161, a PDE number (PDE code) 162 and each outlet code 163 are saved to the built-in memory 110, and thereby simplify constituent of the PDE 1.

Figure 6:
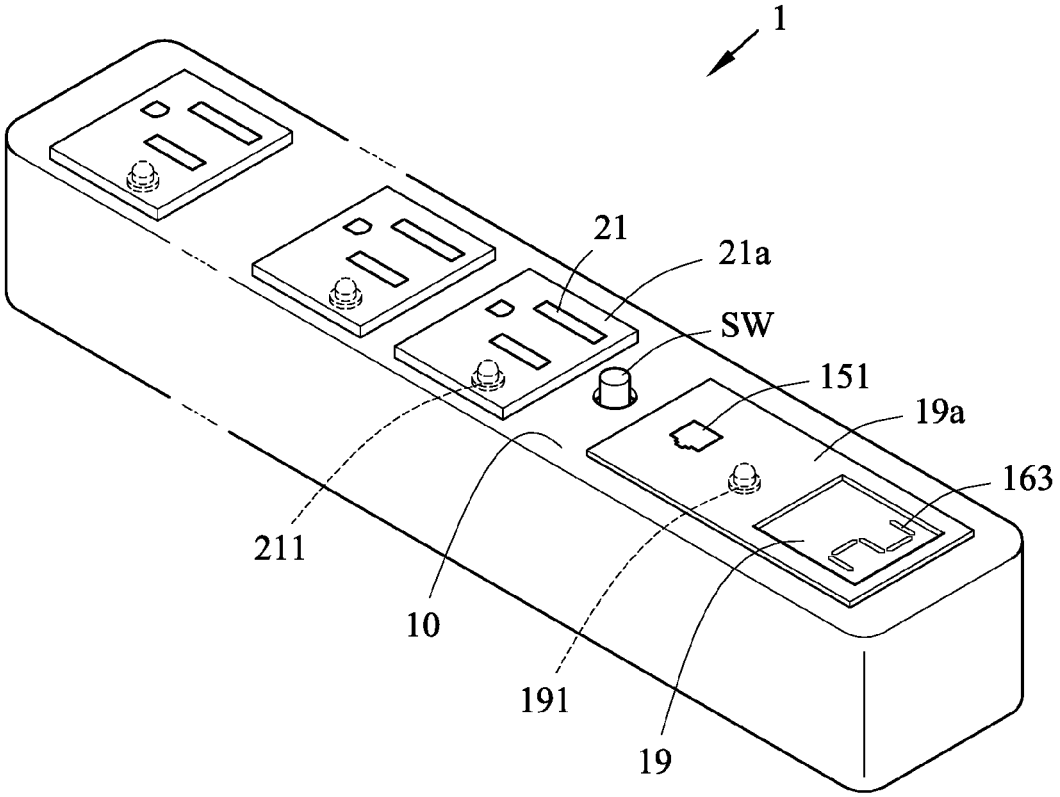
FIG. 6 is a perspective view showing a PDE of a sixth embodiment of the invention.

Referring to FIG. 6, a PDE indicator light 191 in accordance with a sixth embodiment is located on an underside of a PDE panel 19*a*; wherein the PDE panel 19*a* can be selected from a transparent material, a translucent material or a light guiding material, therefore can protect the PDE indicator light 191. Thus, a PDE 1 can enhance an effect of PDE identification by radiation of the PDE panel 19*a*.

Figure 7:
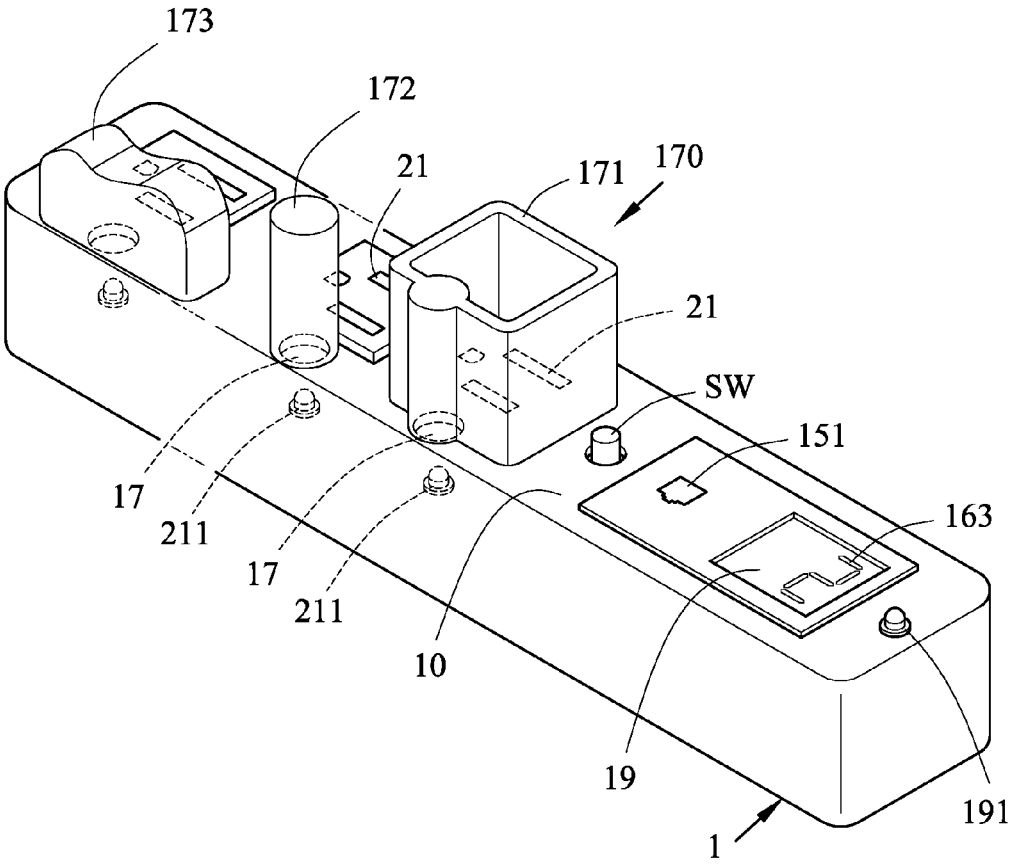
FIG. 7 is a perspective view showing a PDE of a seventh embodiment of the invention.
Figure 7A:
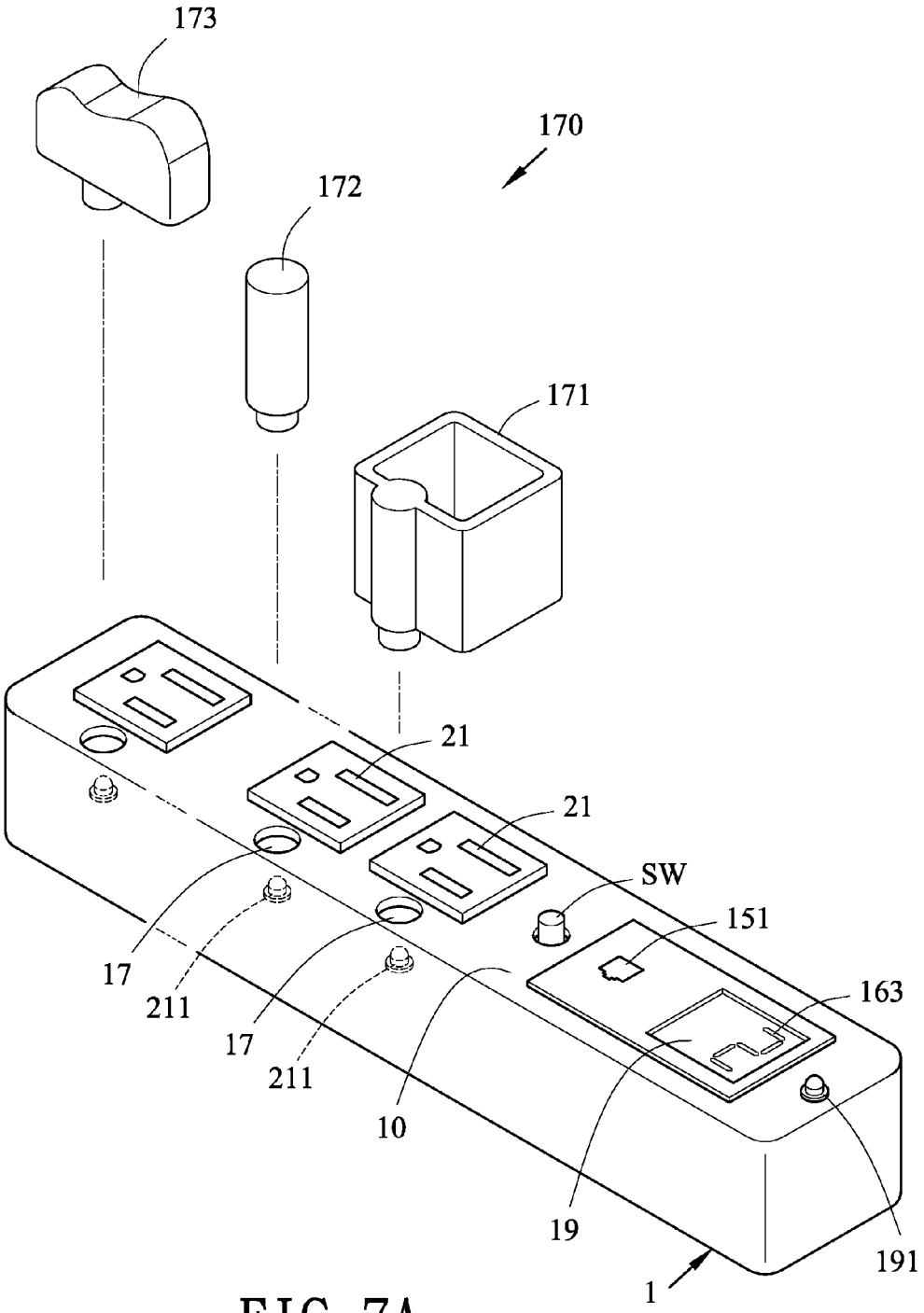
FIG. 7A is a exploded view showing the PDE of the seventh embodiment of the invention.

Referring to FIGS. 7 to 7A, a PDE 1 in accordance with a seventh embodiment has a plurality of through holes 17; wherein each outlet indicator light 211 is located on an underside of each through hole 17, an upside of each through hole 17 can dispose a light guiding element 170, the light guiding element 170 can be selected from a light guiding element 171 of rectangle frame, a light guiding element 172 of geometric shape or a light guiding element 173 of non-geometric shape. When a plurality of device power plugs (not shown) are individually plugged in a plurality of outlets 21, the device power plugs will be possible to block user sight, the light guiding element 170 is just to enhance an effect of outlet identification.

Figure 8:
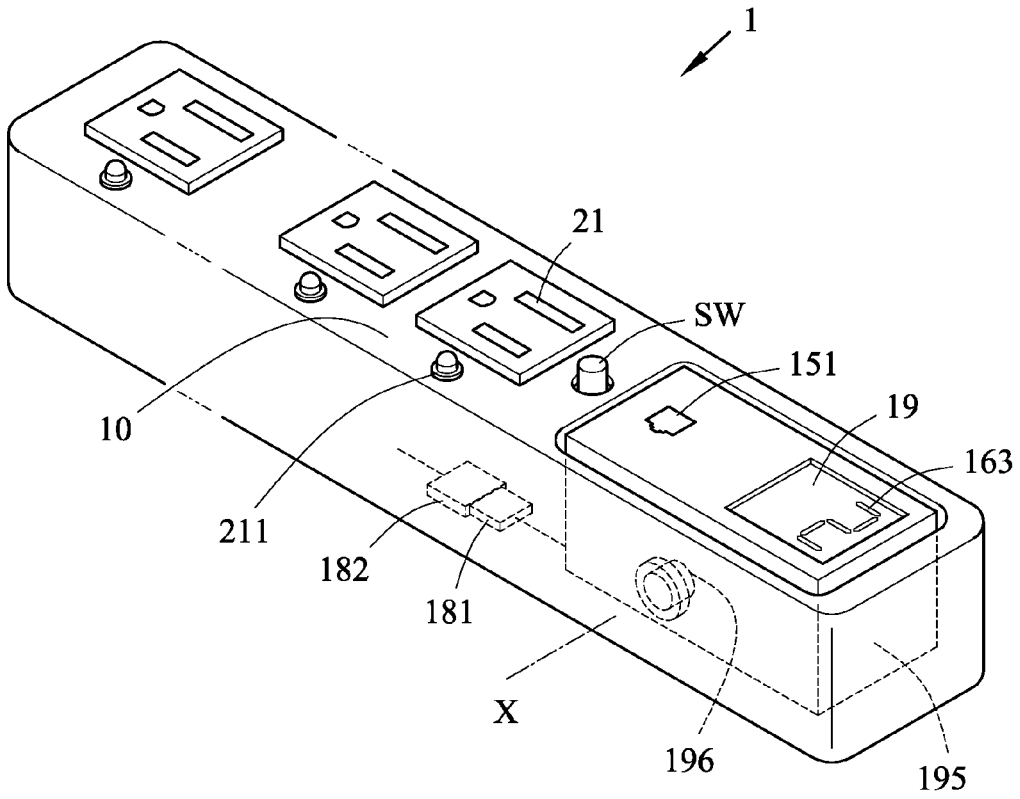
FIG. 8 is a perspective view showing a PDE of a eighth embodiment of the invention.
Figure 8A:
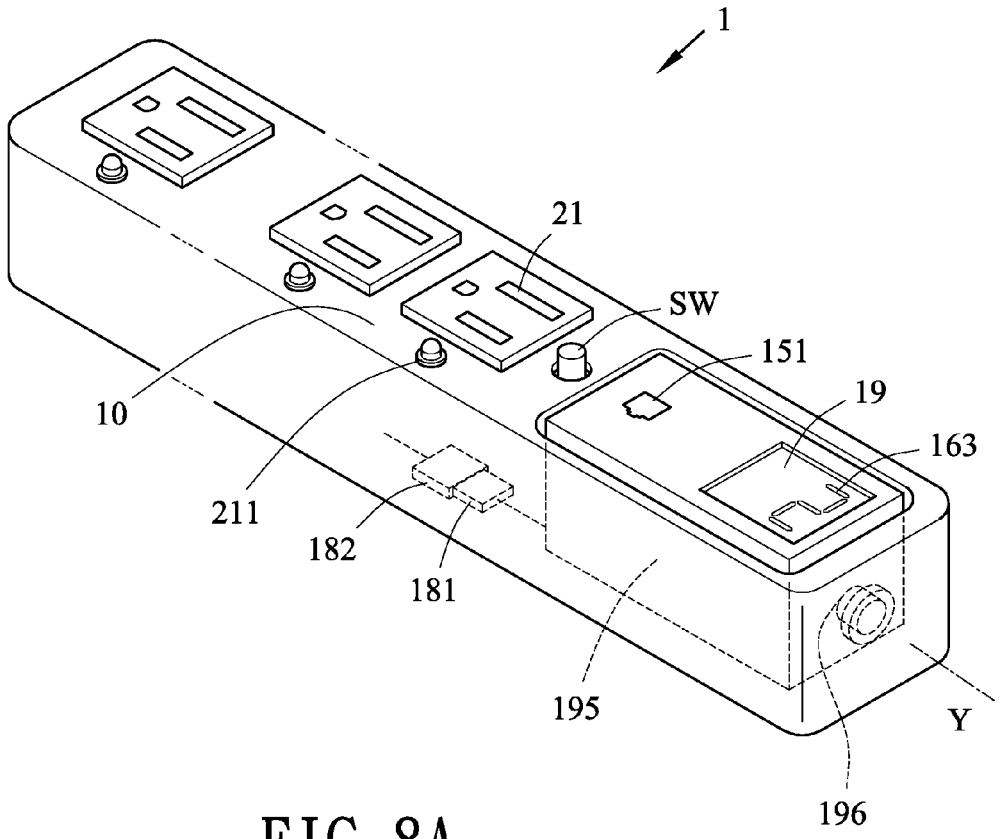
FIG. 8A is a exploded view showing the PDE of the eighth embodiment of the invention.

Referring to FIGS. 8 to 8A, a PDE display 19 of PDE 1 in accordance with an eighth embodiment is disposed at a control box 195; wherein the control box 195 uses a first connector 181 to electrically connect with a second connector 182 of PDE 1, the control box 195 can be replaced, therefore can quickly repair the PDE 1. Moreover, the control box 195 can be pivoted to the PDE 1, the PDE display 19 can adjust sight angle by the control box 195, a pivot direction of a pivot shaft 196 of control box 195 can be selected from a X axial direction of the PDE 1 (as shown in FIG. 8) or a Y axial direction of the PDE 1 (as shown in FIG. 8A).

Figure 9:
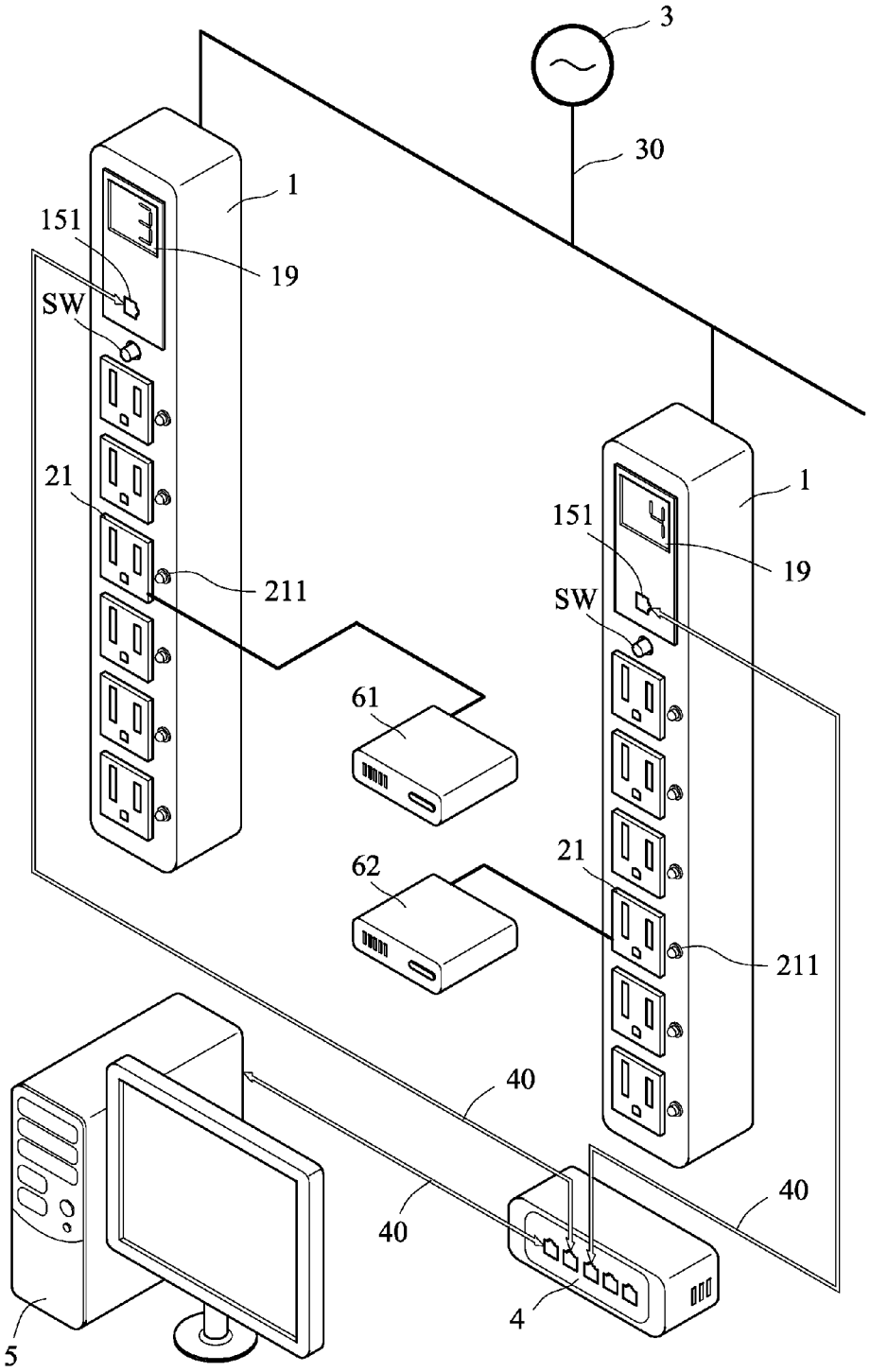
FIG. 9 is a perspective view showing a first plug-in manner of powered devices of a ninth embodiment of the invention.
Figure 9A:
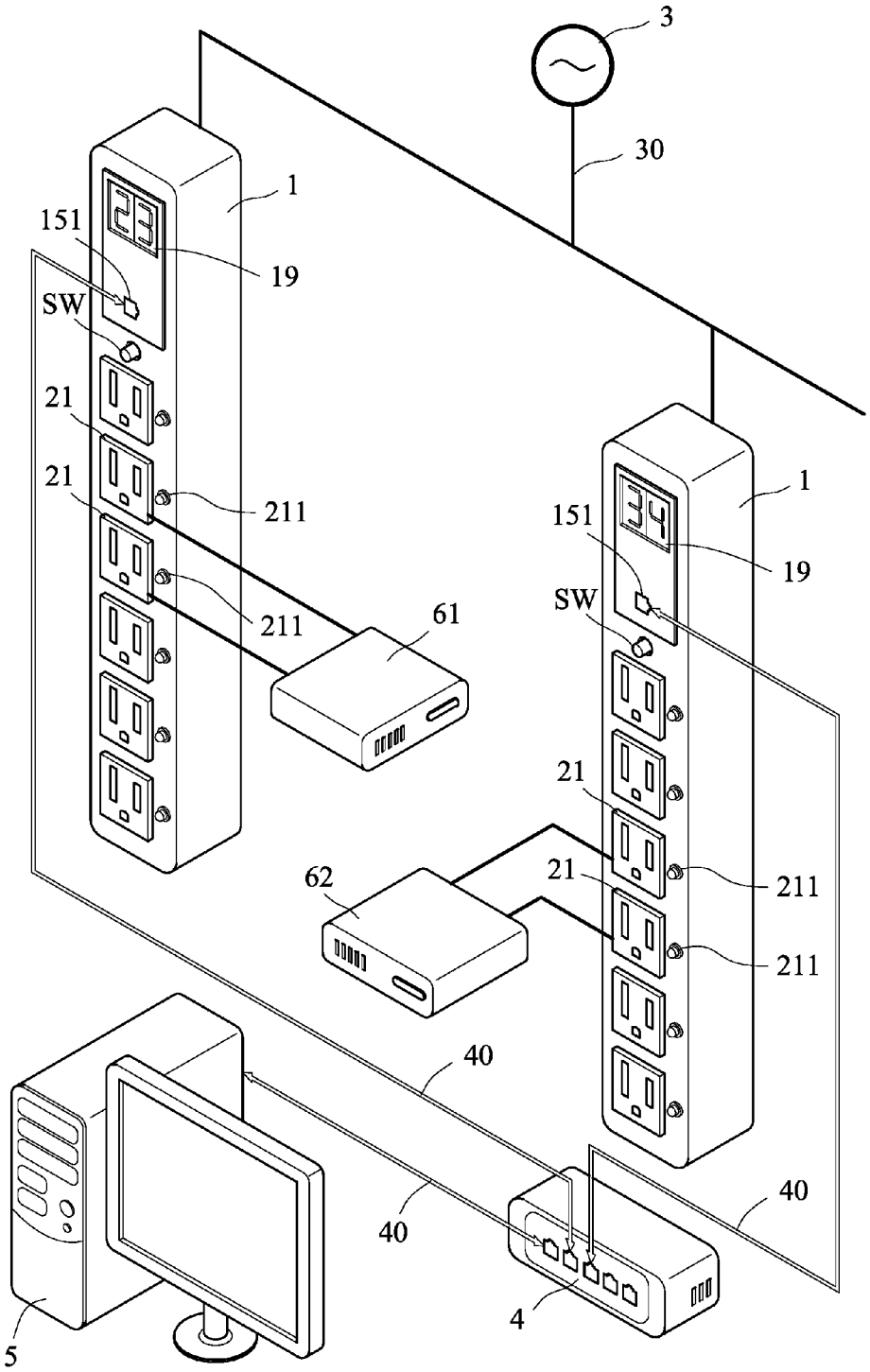
FIG. 9A is a perspective view showing a second plug-in manner of powered devices of the ninth embodiment of the invention.
Figure 9B:
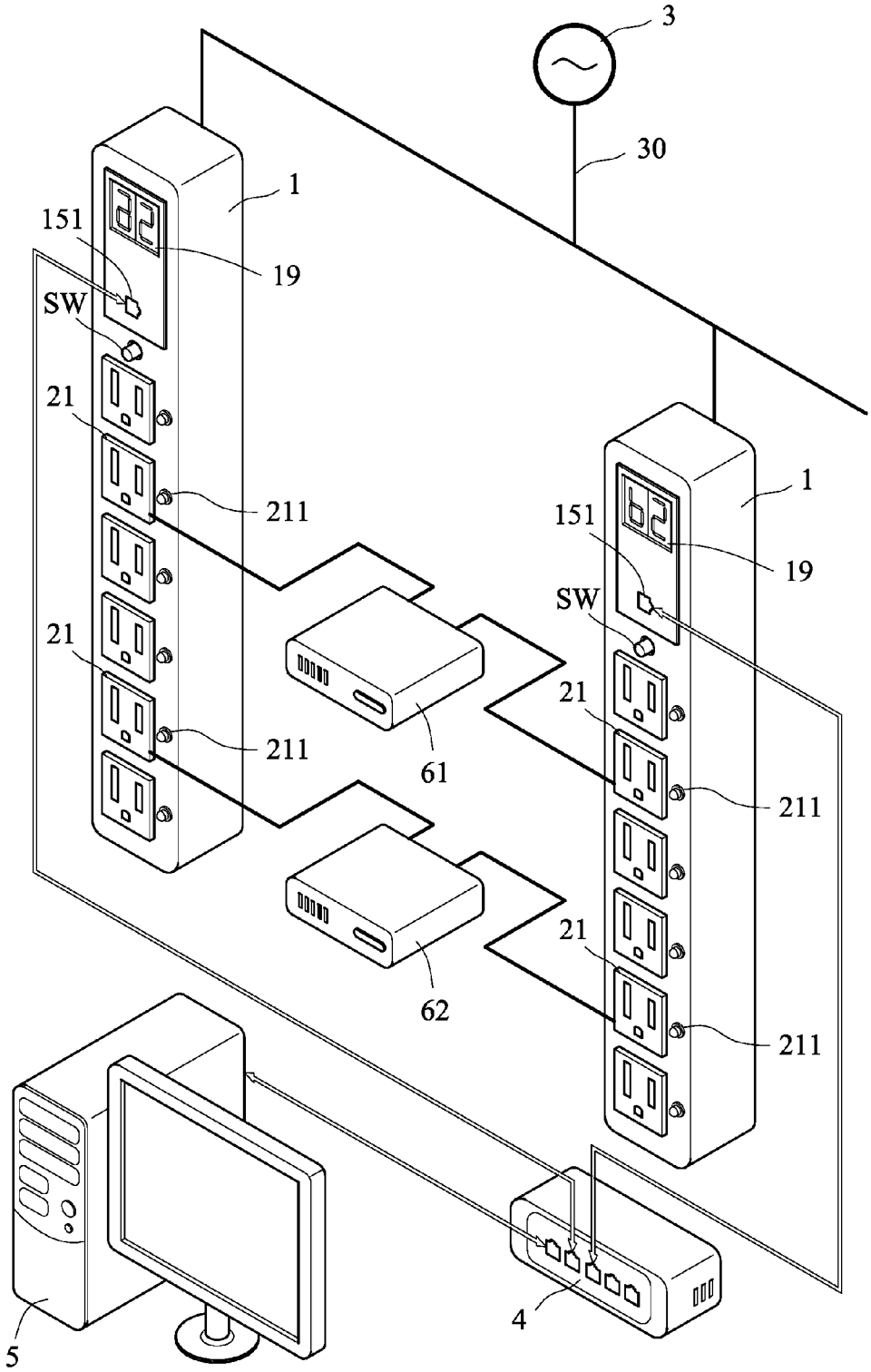
FIG. 9B is a perspective view showing a third plug-in manner of powered devices of the ninth embodiment of the invention.

Referring to FIGS. 9 to 9B, plug-in positions of powered devices 61 can adopt a one-to-one manner or a one-to-two manner; wherein the one-to-one manner is defined as that a powered device 61 electrically connects to an outlet 21 of a PDE 1 (as shown in FIG. 9), the one-to-two manner is defined as that a powered device 61 electrically connects to two outlets 21 of the same PDE 1 (as shown in FIG. 9A), or the one-to-two manner is defined as that a powered device 61 electrically connects to two outlets 21 of the different PDEs 1 (as shown in FIG. 9B). User does not need to inquire about an IP address and an outlet code of each powered device 61, and user can quickly find out a correct plug-in position of each powered device 61, therefore can make a replacement, a repair or a test for the powered devices 61, and prevent to imprudently break off the power of other devices 62.

What is claimed is:

1. A power apparatus with outlet identification capability, the power apparatus including at least one PDE (power distribution equipment), the PDE comprising:

a power input terminal used to connect to a power source;

a plurality of outlets used to distribute input power of the power input terminal;

a processor unit used to process an identification requirement, the processor unit connected with a network interface unit, the processor unit can receive the identification requirement via the network interface unit;

an identification data having an IP (internet protocol) address and an outlet code of each outlet of the plurality of outlets, respectively; and a plurality of outlet indicator lights, each outlet code corresponding to an outlet indicator light of the plurality of outlet indicator lights with respect to the position of each outlet of the plurality of outlets, respectively;

wherein the identification requirement has the IP address and at least one outlet code of the identification data, therefore the processor unit can drive the respective outlet indicator light of the plurality of outlet indicator lights to radiate according to the identification requirement to indicate a correct position of the respective outlet of the plurality of outlets relative to the position of the respective outlet to assist an individual in case a device plugged into the respective outlet needs to be replaced, repaired, or tested, to ensure that the individual does not break off power of any devices connected to other outlets of the plurality of outlets.

2. The power apparatus with outlet identification capability of claim 1, wherein a storage position of the identification data can be selected from a memory unit or a built-in memory of the processor unit; the network interface unit can be selected from an Ethernet network interface or an optical fiber network interface, the network interface unit has at least one network port, the network port can be selected from a RJ45 network socket or an optical fiber network socket.

3. The power apparatus with outlet identification capability of claim 1, wherein a location of each outlet indicator light can be selected from a top surface of the PDE or an underside of each outlet panel; the above outlet indicator lights can be selected from a LED (light emitting diode) lamp or a small lamp, the above outlet panel can be selected from a transparent material, a translucent material or a light guiding material.

4. The power apparatus with outlet identification capability of claim 1, wherein a top surface of the PDE further disposes a PDE indicator light, the processor unit can drive the PDE indicator light to radiate according to the IP address of the identification requirement;

the PDE indicator light can be selected from a LED lamp or a small lamp.

5. The power apparatus with outlet identification capability of claim 1, wherein the PDE has at least one switch used to stop the radiation of the outlet indicator light and the PDE indicator light, the switch SW can be selected from a rocker switch, a push switch, a toggle switch, a DIP switch or a touch switch.

6. The power apparatus with outlet identification capability of claim 1, wherein the PDE has a plurality of through holes, each outlet indicator light is located on an underside of each through hole, a light guiding element is disposed at an upside of each through hole, the above light guiding element can be selected from a light guiding element of rectangle frame, a light guiding element of geometric shape or a light guiding element of non-geometric shape.

7. A power apparatus with outlet identification capability, the power apparatus including at least one PDE power distribution equipment (PDE), the PDE comprising:

a power input terminal used to connect to a power source;

a plurality of outlets used to distribute input power of the power input terminal, each outlet having a respective position relative to the PDE;

a processor unit used to process an identification requirement, the processor unit connected with a network interface unit, the processor unit can receive the identification requirement via the network interface unit;

an identification data having an IP address and an outlet code of each outlet of the plurality of outlets, respectively; and a PDE display electrically connected to the processor unit;

wherein the identification requirement has the IP address and at least one outlet code of the identification data, therefore the processor unit can drive the PDE display to show the at least one outlet code of the identification requirement to indicate a correct position of a respective outlet of the plurality of outlets corresponding to the at least one outlet code of the identification, to assist an individual in case a device plugged into the respective outlet needs to be replaced, repaired, or tested, to ensure that the individual does not break off power of any devices connected to other outlets of the plurality of outlets.

8. The power apparatus with outlet identification capability of claim 7, wherein a storage position of the identification data can be selected from a memory unit or a built-in memory of the processor unit; the network interface unit can be selected from an Ethernet network interface or an optical fiber network interface, the network interface unit has at least one network port, the network port can be selected from a RJ45 network socket or an optical fiber network socket.

9. The power apparatus with outlet identification capability of claim 7, wherein the identification data further has a PDE number (PDE code), the processor unit can drive the PDE display to show the PDE number according to the identification requirement, the PDE number can be selected from one-dimensional array value, two-dimensional arrays value or multi-dimensional arrays value.

10. The power apparatus with outlet identification capability of claim 7, wherein the PDE further has a PDE panel, a PDE indicator light is located on an underside of the PDE panel, the processor unit can drive the PDE indicator light to radiate according to the identification requirement, the PDE indicator light can be selected from a LED lamp or a small lamp, the PDE panel can be selected from a transparent material, a translucent material or a light guiding material.

11. The power apparatus with outlet identification capability of claim 7, wherein the PDE display is disposed at a control box, the control box uses a first connector to electrically connect with a second connector of the PDE, the control box can be replaced, therefore can quickly repair the PDE.

12. The power apparatus with outlet identification capability of claim 11, wherein the control box can be pivoted to the PDE, the PDE display can adjust sight angle by the control box, a pivot shaft direction of the control box can be selected from a X axial direction or a Y axial direction of the PDE.

13. An outlet identification method of power apparatus comprising the steps of:

S1) setting identification datum of a plurality of power distribution equipment (PDE), wherein the identification datum comprises a plurality of IP addresses and a plurality of outlet codes, each outlet code of the plurality of outlet codes uniquely identifies an outlet included in one of the PDEs, respectively, and each IP address uniquely identifies one of the plurality of PDEs, respectively;

S2) performing an outlet identification function of a computer having a user interface and that is connected to the PDEs by a network;

S3) transmitting a network packet by the computer, the network packet has an identification requirement, the identification requirement has at least one IP address and at least one outlet code of the plurality of outlet codes;

S4) at least one IP address of the plurality of plurality of IP addresses is set to the IP address of identification requirement to identify a conformed PDE of the plurality of PDEs, and the conformed PDE can perform an indication function according to the outlet code of identification requirement;

wherein the indication function is defined as that at least one outlet indicator light of the conformed PDE can be driven to radiate, or a PDE display of the conformed PDE can be driven to show the outlet code of identification requirement, therefore a plug-in position of at least one powered device can be identified to indicate a correct position of an outlet identified by outlet code of the identification requirement, to assist an individual in case a device plugged into the respective outlet needs to be replaced, repaired, or tested, to ensure that the individual does not break off power of any devices connected to other outlets of the plurality of outlets.

14. The outlet identification method of power apparatus of claim 13, wherein the user interface has a data form, the data form has a device field, an IP address field and an outlet code field; each data has an executing key, user can click any executing key to transform the data to an identification requirement, and the computer will transmit the identification requirement to a plurality of PDEs by a network packet manner.

15. The outlet identification method of power apparatus of claim 13, wherein the method further comprises the steps of:

S5) performing a function of stopping indication by computer, the user interface has a stop key, user can click the stop key to transmit a network packet of stopping requirement to the PDEs, the stopping requirement has at least one IP address, at least one IP address of PDE is conformed to the IP address of stopping requirement, and the conformed PDE will stop the indication function.

16. The outlet identification method of power apparatus of claim 13, wherein the user interface has at least one indication function adjustment option, the indication function adjustment option can be selected from a color adjustment option, a flash switch adjustment option or a flash frequency adjustment option, therefore can quickly adjust a radiation mode of the outlet indicator lights or a display mode of the PDE display.

17. The outlet identification method of power apparatus of claim 13, wherein the user interface has a data form, a confirming key and a cancel key; the data form has a device field, an IP address field, an outlet code field and a select field, user can select a data or a plurality of datum by a plurality of select field options, user can click the cancel key to cancel any select field option, and user can click the confirming key to transform the selected data or a plurality of selected datum to an identification requirement, and computer will transmit the identification requirement to a plurality of PDEs by a network packet manner.

18. The outlet identification method of power apparatus of claim 13, wherein the user interface has a device matrix, each device has at least one corresponding description area, each description area has at least one IP address and at least one outlet code, when a cursor is moved to a device of the device matrix, the user interface can display a description area, a user can click any device of the device matrix to transmit a network package of identification requirement to a plurality of PDEs.

19. The outlet identification method of power apparatus of claim 13, wherein the user interface has a data form, the data form has a device field, an IP address field, a PDE number (PDE code) field and an outlet code field; each identification data has a PDE number, the indication function includes that each PDE display can be driven to show each PDE number, the PDE numbers can be selected from one-dimensional array value, two-dimensional arrays value or multi-dimensional arrays value.

20. The outlet identification method of power apparatus of claim 13, wherein plug-in positions of powered devices can adopt a one-to-one manner or a one-to-two manner; the one-to-one manner is defined as that a powered device electrically connects to an outlet of a PDE, the one-to-two manner is defined as that a powered device electrically connects to two outlets of the same PDE, or the one-to-two manner is defined as that a powered device electrically connects to two outlets of the different PDEs.

* * * * *